US007625297B1

(12) United States Patent
Simonis

(10) Patent No.: US 7,625,297 B1
(45) Date of Patent: Dec. 1, 2009

(54) GOLF CLUB SHAFT WITH ADJUSTABLE STIFFNESS

(76) Inventor: Steven F. Simonis, 335 Olenview Cir., Powell, OH (US) 43065

( * ) Notice: Subject to any disclaimer, the term of this patent is extended or adjusted under 35 U.S.C. 154(b) by 0 days.

(21) Appl. No.: 12/138,935

(22) Filed: Jun. 13, 2008

(51) Int. Cl.
*A63B 53/10* (2006.01)

(52) U.S. Cl. ..... 473/318

(58) Field of Classification Search ..... 473/318
See application file for complete search history.

(56) References Cited

U.S. PATENT DOCUMENTS 5,683,308 A * 11/1997 Monette ..... 473/318
6,241,623 B1 * 6/2001 Laibangyang ..... 473/232
6,361,451 B1 * 3/2002 Masters et al. ..... 473/318
7,252,597 B2 * 8/2007 Li et al. ..... 473/318
2003/0027658 A1 * 2/2003 Li et al. ..... 473/318

* cited by examiner

*Primary Examiner*—Stephen L. Blau
(74) *Attorney, Agent, or Firm*—Frank H. Foster; Kremblas, Foster, Phillips & Pollick

(57) ABSTRACT

A golf club shaft having adjustable stiffness. An elongated tensioning member extends through the shaft and is mounted to both ends of the shaft. A tensioner assembly is mounted to the shaft and is connected to the tensioning member for allowing manual adjustment of the axial tension in the tensioning member, thereby allowing a technician or a user to increase or decrease the stiffness of the shaft as desired.

7 Claims, 3 Drawing Sheets

GOLF CLUB SHAFT WITH ADJUSTABLE STIFFNESS

BACKGROUND OF THE INVENTION

1. Field of the Invention

This invention relates generally to the field of golf equipment and relates more particularly to an improved golf club shaft with manually adjustable stiffness.

2. Description of the Related Art

Golfers of all skill levels are continually striving to increase the distance and accuracy of their golf shots. With the constant introduction of new materials and manufacturing methods to the sport of golf, equipment is playing an ever more important role in overall game improvement. Golf clubs, in particular, have benefited greatly from recent advances in technology. Larger club heads, titanium faces, and graphite shafts are just a few of the innovations that are enabling players to hit the ball further and straighter than ever before.

Widely regarded as the "engine" that drives the head of a golf club, a club's shaft has a substantial effect on a golfer's ability to achieve optimal contact between the club face and a golf ball. Undoubtedly, the most important characteristic of a shaft is its flexibility. A shaft's "flex rating" indicates the ease with which the shaft bends when forces are applied to it. The five most common flex ratings, in order from least flexible to most flexible, are Extra Stiff, Stiff, Regular, Senior, and Ladies (typically denoted by the letters X, S, R, A, and L, respectively). Generally, golfer's having higher swing speeds require a stiffer shaft, while golfer's having slower swing speeds fair better with a more flexible shaft. A shaft that is not properly matched to a particular golfer's swing can result in weaker ball contact as well as a variety of mishits.

To understand why the flexibility of golf club's shaft is so important, it is essential to first understand some of the forces that work on the shaft during a golf swing. As a player initiates his/her downswing, the head-end of the shaft will bend away from the ball in opposition to the forced movement of the club along the player's swing arc as a result of the F=ma force on the club head. By bending, the shaft stores energy in the manner of a spring. Immediately after the player achieves his/her peak swing acceleration, the energy stored in the shaft is released, forcing the shaft to "kick," or unbend back toward a straight position. This "kicking" of the shaft increases the velocity of the club head along the swing arc as the bent portion of the shaft accelerates to return toward its equilibrium position.

In order to achieve ideal impact conditions, the club face should be traveling at its peak velocity, should neither be too shallow nor too lofted, and should be laterally square with respect to the target line. A shaft that is properly matched to a player's swing will kick at the correct time and will have returned to a substantially straight position at impact, indicating that the maximum amount of stored energy has been transferred from the shaft to the ball. If a player makes a good swing with a properly matched shaft, the ball will fly straight and far.

If a player uses a shaft that is too flexible for his/her particular swing, the shaft will kick prematurely and will flex past a straight position before contact, causing the shaft to be bent toward the ball at the time of impact. The result is a club face that is decelerating, overly shut, and excessively lofted when it meets the ball. Given an otherwise good swing by the player, the ball will tend to fly too high, to the left of the intended target (for a right-handed player), and short.

Conversely, if a player uses a shaft that is too stiff for his/her swing, the shaft will kick too late and will be bent away from the ball at the time of impact. The result is a club face that is open, shallow, and that has yet to reach its maximum potential velocity. Again, given an otherwise good swing by the player, the ball will tend to fly too low, to the right of the intended target (for a right-handed player), and short.

In addition to affecting the behavior of the shaft during a swing, shaft stiffness is also a major contributor to the overall feel of a golf club. When the clubface is brought into contact with a ball, a shaft that is more rigid will transmit a greater amount of vibration from the clubface to the golfer's hands. A more flexible shaft will dampen a greater amount of that vibration. More experienced players tend to prefer some measure of vibratory feedback to provide them with an indication of how the clubface interacts with the ball, such as whether they've struck the ball with the heel, the toe, or the center of the clubface. A stiffer shaft will provide such feedback. Less experienced players generally prefer a consistently solid feel through impact, regardless of how well they've actually struck the ball. A more flexible shaft will provide such feel.

Conventional golf club shafts are of fixed stiffness and, as described above, are generally only available in a limited number of incremental flex ratings. If a particular golfer is best matched with a shaft having a flex rating that falls somewhere between those that are commercially available, that golfer is forced to sacrifice some measure of performance and feel and must choose a shaft that is either too stiff or too flexible for his or her swing. Moreover, if a particular golfer's swing characteristics change over the course of time, that golfer must purchase a number of different shafts in order to maintain optimal matching.

It is therefore desirable to have a golf club shaft that can be manually adjusted to be more or less stiff. It is also desirable to have such a shaft that can be quickly and conveniently adjusted by a user or a technician.

BRIEF SUMMARY OF THE INVENTION

In accordance with the purposes of this invention, there is provided a conventional golf club shaft that is preferably constructed from graphite. The shaft is hollow and tapered with a narrow head-end and a wide grip-end.

A strand of preferably durable and lightweight tensioning material extends along the axis of the shaft and forms a tensioning member. One end of the strand is attached to the shaft's club head tip and preferably is mounted to a conventional shaft tip weight that is installed in the head-end of the shaft. The opposite end of the strand is preferably retained by a manually adjustable tensioner assembly that is mounted to the grip-end of the shaft. A conventional rubber golf club grip, preferably modified to have a removable end-cap, fits over both the tensioner assembly and the grip-end of the shaft.

In order to increase the stiffness of the shaft, the end-cap is removed from the grip and the tensioner assembly is manipulated to increase the axial tension in the tensioning material, thereby increasing the amount force that urges the shaft to a straight configuration. In order to decrease the stiffness of the shaft, the tensioner assembly is manipulated to decrease the axial tension in the tensioning material, thereby decreasing the amount of force that urges the shaft to a straight configuration.

Figure 1:
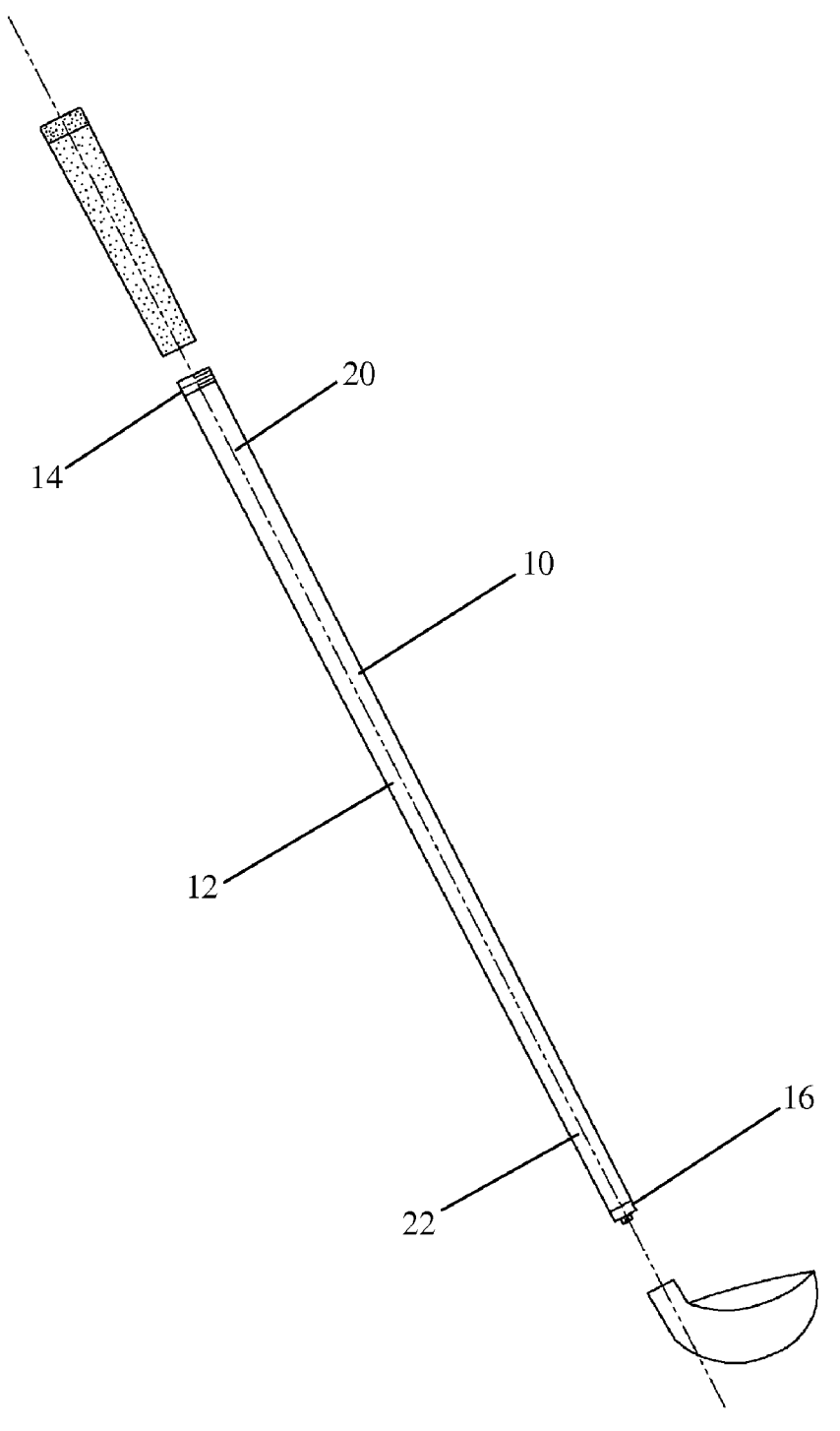
FIG. 1 is an exploded view illustrating the invention installed in a conventional golf club.

In describing the preferred embodiment of the invention which is illustrated in the drawings, specific terminology will be resorted to for the sake of clarity. However, it is not intended that the invention be limited to the specific term so selected and it is to be understood that each specific term includes all technical equivalents which operate in a similar manner to accomplish a similar purpose. For example, the word connected or term similar thereto are often used. They are not limited to direct connection, but include connection through other elements where such connection is recognized as being equivalent by those skilled in the art.

DETAILED DESCRIPTION OF THE INVENTION

Figure 2:
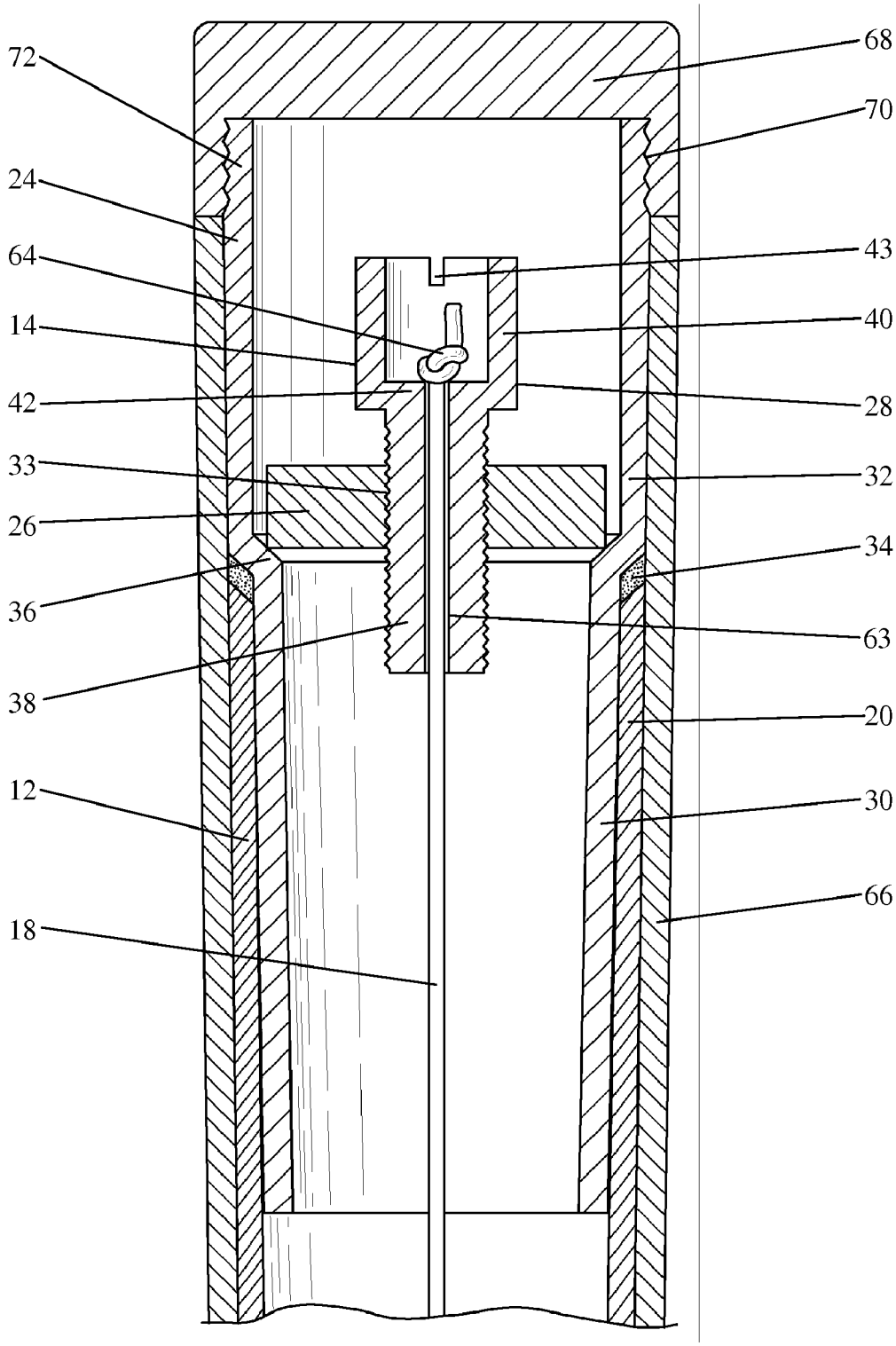
FIG. 2 is a cross-sectional view illustrating the grip-end of the golf club shown in FIG. 1.
Figure 3:
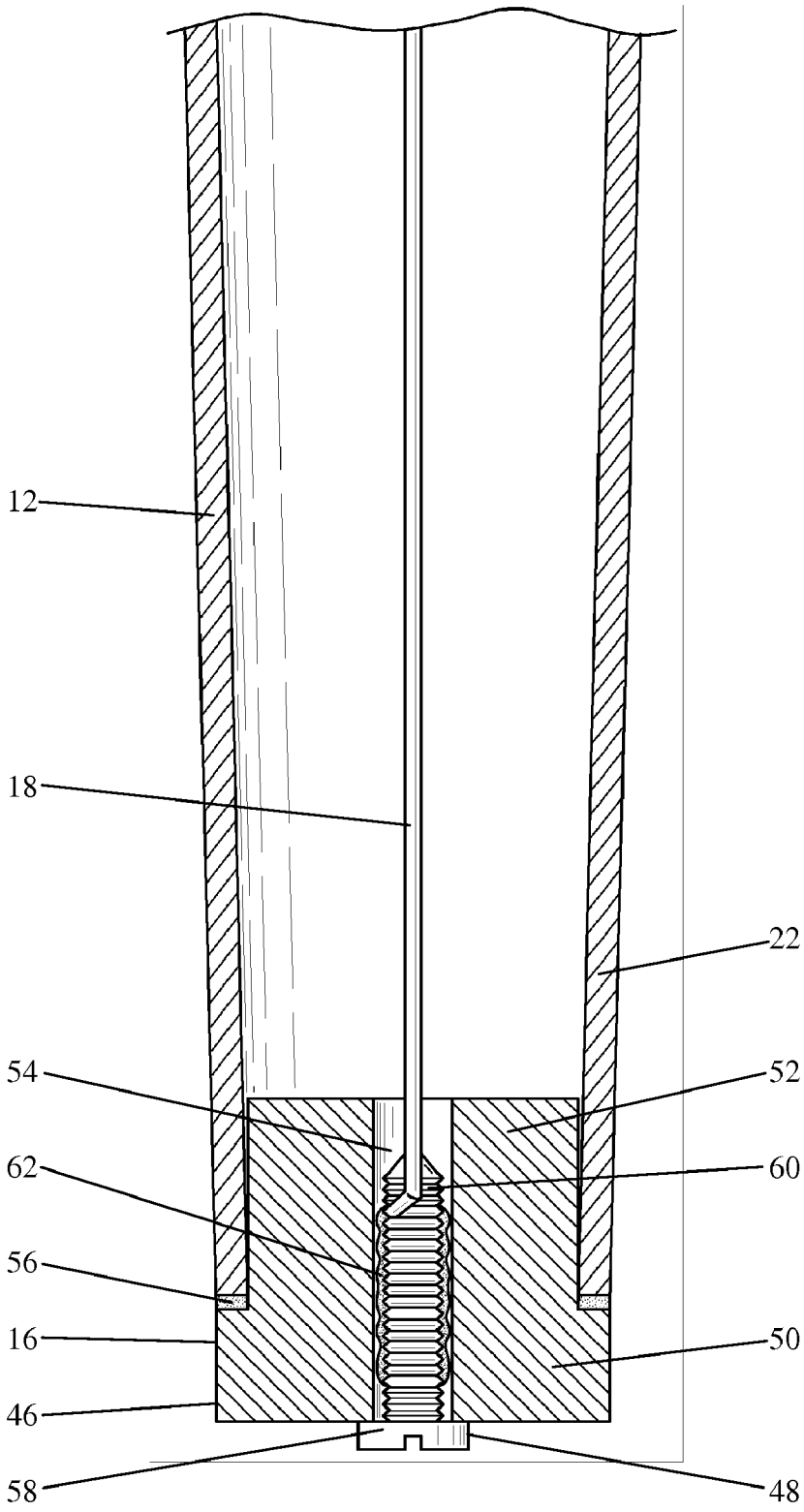
FIG. 3 is a cross-sectional view illustrating the head-end of the golf club shown in FIG. 1.

Referring to FIGS. 1-3, the adjustable shaft 10 has a conventional graphite golf club shaft 12, a tensioner assembly 14, a retainer assembly 16, and a tensioning member 18. Referring to FIG. 1, the conventional shaft 12 is a tapered, tubular body with a wide grip-end 20 and a narrow head-end 22. The shaft 12 is a standard, 43 inch, regular flex driver shaft, although the length and the flex of the shaft 12 may be varied to suit a particular application.

Referring to FIG. 2, the tensioner assembly 14 has a golf club shaft extension 24, a tensioning nut 26, and a tensioning barrel 28. The shaft extension 24 is of a conventional type that will be familiar to those skilled in the art, having a narrow mounting portion 30 and a wide extending portion 32. The extension 24 is mounted to the grip-end 20 of the shaft 12 in a conventional manner, with the mounting portion 30 within the shaft 12 and the extending portion 32 protruding approximately 1 inch from the shaft 12. The extending portion 32 may be made longer to suit a particular golfer, but should generally not be less than one inch in length. The mounting portion 30 of the extension 24 snugly engages the interior of the shaft 12, and the outer diameter of the extending portion 32 is substantially equal to the outer diameter of the shaft 12. A small amount of marine epoxy 34 is used to securely affix the shaft extension 24 to the shaft 12, although all other means of fastening, such as glue, double-sided adhesive strips, various types of friction fits, and other types of epoxy, are also contemplated.

The tensioning nut 26 is an annular body with a threaded interior surface 33. The nut 26 is situated within the extending portion 32 of the shaft extension 24 and is coaxial with the shaft 12. The inner diameter of the extending portion 32 is larger than the inner diameter of the mounting portion 30, thus creating an interior nut retaining shoulder 36 at the juncture of the two portions. The outer diameter of the tensioning nut 26 is smaller than the inner diameter of the extending portion 32, but is larger than the inner diameter of mounting portion 30. Therefore, the tensioning nut 26 can fit within the extending portion 32, but cannot pass through the nut retaining shoulder 36 into the mounting portion 30. Axial forces on tensioning nut 26 (described in greater detail below) keep the nut 26 in firm engagement with the nut retaining shoulder 36.

Still referring to FIG. 2, the tensioning barrel 28 is a tubular body having a fastening segment 38 and a head segment 40. The fastening segment 38 has a threaded exterior surface for engaging the threaded interior surface 33 of the tensioning nut 26 in the manner of a conventional nut and bolt. The tensioning barrel 28 can therefore be moved axially relative to the tensioning nut 26 by rotating the barrel 28 about its axis.

The outer diameter of the head segment 40 is larger than the diameter of the aperture in the tensioning nut 26, thereby preventing the tensioning barrel 28 from being screwed into the nut 26 past the lower edge of the head segment 40. The inner diameter of the head segment 40 is also larger than the inner diameter of the fastening segment 30, thus creating an interior barrel retaining shoulder 42 at the juncture of the two segments 38 and 40.

Two axially-aligned adjustment notches 43 and 44 (notch 44 is not within view, but is substantially identical to notch 43) are cut into the top edge of the head segment 40 for accepting a flat-head screwdriver. Although two axially-aligned notches are preferred, it is contemplated that the head segment 40 could be cut or formed in any manner appropriate for accommodating a number of other torquing tools, such as a Phillips-head screwdriver or a socket wrench.

Referring to FIG. 3, the retainer assembly 16 has a conventional golf club tip weight 46 and a retaining screw 48. The tip weight 46 has a wide cap segment 50, a narrow neck segment 52, and an axial passageway 54. The tip weight 46 is installed in the head-end 22 of shaft 12 in a conventional manner well known to those skilled in the art, with the neck segment 52 mounted snugly within the shaft 12 and the cap segment 50 protruding from the shaft 12. The cap segment 50 is axially aligned with and abuts the head-end 22 of the shaft 12, and a small amount of epoxy 56 is used to create a secure bond between the weight 46 and the shaft 12.

The retaining screw 48 is a conventional screw having a head 58 and a threaded portion 60. Although a screw is preferred, it is contemplated that a similar structure, such as a bolt or a pin, can also be used. The threaded portion 60 is inserted into the bottom end of the axial passageway 54, and the head 58 abuts the bottom of the tip weight 46. The diameter of the axial passageway 54 is larger then the outer diameter of the threaded portion 60, but is smaller than the outer diameter of the head 58. Therefore, the threaded portion 60 fits within the passageway 54 without engaging the interior surface of the passageway 54, but the screw 48 is prevented from passing through the passageway 54 past the top edge of the head 58. The head 58 is kept in firm engagement with the bottom of the weight 46 by axial forces acting on the screw 48 (described in greater detail below).

Referring to FIGS. 2 and 3, the tensioning member 18 is an elongated strand of a thermoplastic material sold under the trade name Spectra fiber. Although it is preferred that the tensioning member be fabricated from Spectra fiber, all other materials that are suitably strong, lightweight, and that can be placed in tension and that can thereafter retain that tension, are also contemplated. Examples include metals such as titanium and steel, para-aramid fibers such as Kevlar, Technora, and Twaron, and other thermoplastics, such as Dyneema.

Referring to the retainer assembly 16 in FIG. 3, the tensioning member 18 is wound tightly around and tied to the threaded portion 60 of the retaining screw 48. A small amount of marine epoxy 62 is applied to create a permanent bond between the tensioning member 18 and the screw 48, although the use of all other adhesives and means of permanently affixing the member 18 to the screw 48, such as glue or welds, are also contemplated. It is further contemplated that the retaining screw 48 can be omitted, and that the tensioning member 18 can be mounted directly to the tip weight 46.

Referring now to FIG. 2, the tensioning member 18 passes through a passage 63 formed axially through the fastening segment 38 of the tensioning barrel 28 and terminates in a knot 64 within the head segment 40 of the barrel 28. The knot 64 is smaller than the inner diameter of the head segment 40, but is larger than the diameter of the passage 63. Thus, the knot 64 can fit within the head segment 40, but is prevented from being pulled down, through the interior barrel retaining shoulder 42. Although a knot is the preferred means for retaining the tensioning member 18 at the tensioning barrel 28, all other means for retaining the tensioning member 18, such as those described above in connection with the retainer assembly 16, are also contemplated.

Referring to FIGS. 2 and 3, the tensioning member 18 extends substantially along the axis of the shaft 12 from the grip-end 20 to the head-end 22. The tensioning member 18 is always kept taut between the retaining screw 48 and the knot 64 with a minimum axial tension sufficient for keeping the tensioning nut 26 in firm engagement with the interior of the shaft extension 24 at the grip-end 20, and for keeping the head 58 of the retaining screw 48 in firm engagement with the tip weight 46 and the head-end 22. Typically, the minimum axial tension will be in the range of 30 to 50 pounds. It is preferred that a single tensioning member be mounted within the shaft, although it is contemplated that more than one member can be simultaneously mounted in a similar manner.

Referring to FIG. 2, a conventional rubber golf club grip 66 fits over both the shaft extension 24 and the grip-end 20 of the shaft 12. The grip 66 has a removable end-cap 68 with a threaded interior surface 70 for engaging a threaded exterior segment 72 of the shaft extension 24. Although it is preferred that the cap 68 threadedly engage the shaft extension 24, all other means of removably securing the cap 68 to the extension 24, such as by snap-fit or friction fit, are also contemplated.

After the adjustable shaft 10 has been installed in a golf club, its stiffness can be adjusted to suit the swing of a particular golfer. The tensioning member is elastomeric and acts as a spring. The spring forces applied by the tensioning member to the opposite ends of the club shaft act to urge the club shaft toward its straight configuration. The forces applied by the tensioning member provide a straightening force that sums with the straightening spring force resulting from bending of the club shaft as a result of its acceleration. However, the straightening force of the tensioning member is adjustable.

Generally, a technician first performs a swing analysis to determine the optimal shaft stiffness for the golfer. The technician then removes the end-cap 66 from the grip and inserts a flathead screwdriver into the shaft extension 24. The head of the screwdriver is brought into engagement with the adjustment notches 43 and 44 in the head segment 40 of the tensioning barrel 28. If the technician wishes to increase the stiffness of the shaft, he/she rotates the barrel 28 counter-clockwise with the screwdriver. Friction between the exterior surface of the tensioning nut 26 and the interior surface of the shaft extension 24, created by axial force on the tensioning nut from the tensioning member 18, prevents the tensioning nut 26 from rotating when the tensioning barrel 28 is rotated. Thus, as the tensioning barrel 28 is rotated counter-clockwise relative to the tensioning nut 26, the distance between the knot 64 and the tensioning nut 26 increases, thereby increasing the axial tension in the tensioning member 18 and increasing the amount of force that urges the shaft toward a straight configuration.

If the technician wishes to decrease the stiffness of the adjustable shaft 10, he/she rotates the tensioning barrel 28 clockwise with the screwdriver to decrease the distance between the knot 64 and the tensioning nut 26, thereby slackening the tensioning member 18 and decreasing the amount of force that urges the shaft toward a straight configuration. Although it is preferred that a trained technician, such as a club maker, repair specialist, or golf instructor perform the analysis and adjustment described, it is contemplated that an untrained owner or user of the shaft 10 could do so as well by repetitive trial and error adjustment and testing.

After an initial adjustment is made to the shaft, a second swing analysis should be performed as a check to ensure optimal matching, after which the shaft 10 can be further adjusted if necessary. This process is repeated until the user and the technician are satisfied with the performance and the feel of the golf club.

This detailed description in connection with the drawings is intended principally as a description of the presently preferred embodiments of the invention, and is not intended to represent the only form in which the present invention may be constructed or utilized. The description sets forth the designs, functions, means, and methods of implementing the invention in connection with the illustrated embodiments. It is to be understood, however, that the same or equivalent functions and features may be accomplished by different embodiments that are also intended to be encompassed within the spirit and scope of the invention and that various modifications may be adopted without departing from the invention or scope of the following claims.

The invention claimed is:

1. An improved golf club shaft having a tapered, tubular body with a grip-end and a head-end that is narrower than the grip end, the improvement comprising:

a. at least one elongated tensioning member having a first end and a second end, the first end mounted to the grip-end of the shaft and the second end mounted to the head-end of the shaft;

b. at least one manually adjustable tensioner assembly mounted to the shaft and connected to the tensioning member for increasing and decreasing axial tension in the tensioning member;

c. a tubular shaft extension having a mounting portion and an extending portion, the mounting portion mounted axially within and rigidly affixed to the grip-end of the shaft, and the extending portion axially protruding from the grip-end of the shaft;

d. an annular tensioning nut having a threaded interior surface, the tensioning nut mounted within the extending portion of the shaft extension and coaxial with the shaft; and e. a tubular tensioning barrel having a threaded exterior surface, the tensioning barrel mounted axially within and threadedly engaging the interior surface of the tensioning nut, the tensioning member extending axially through a passage through the tensioning barrel and terminating in a knot that is larger than the passage so that the knot is too large to pass through the passage of the tensioning barrel.

2. The improved golf club shaft of claim 1, wherein the tensioning member extends substantially along the axis of the shaft.

3. The improved golf club shaft of claim 2, further comprising a tip weight mounted to the head-end of the shaft, the second end of the tensioning member being mounted to the tip weight.

4. The improved golf club shaft of claim 3, further comprising a retaining screw mounted within an axial passageway in the tip weight, the second end of the tensioning member being mounted to the retaining screw.

5. The improved golf club shaft of claim 1, wherein the knot is securely mounted within the tensioning barrel, and a top edge of the tensioning barrel has at least two axially-aligned adjustment notches for accepting a head of a screwdriver.

6. The improved golf club shaft of claim 1, further comprising a golf club grip fitting over both the shaft extension and the grip-end of the shaft, the grip having a removable end-cap for allowing access to the tensioner assembly.

7. The improved golf club shaft of claim 6, wherein the removable end-cap has a threaded interior surface for engaging a threaded exterior surface of the shaft extension.

* * * * *